US005209248A

United States Patent [19]

Slade, Sr.

[11] Patent Number: 5,209,248

[45] Date of Patent: May 11, 1993

[54] SMOKER'S PIPE FILLING AND CLEANING SYSTEM

[76] Inventor: Robert L. Slade, Sr., Rte. 3, Box 156, Perkinston, Miss. 39573

[21] Appl. No.: 715,682

[22] Filed: Jun. 14, 1991

[51] Int. Cl.[5] ..... A24F 9/02; A24F 9/04

[52] U.S. Cl. ..... 131/232; 131/247

[58] Field of Search ..... 131/329, 177, 184.1, 131/232, 247; D32/14

[56] References Cited

U.S. PATENT DOCUMENTS

| | | | |
|---|---|---|---|
| D. 307,202 | 4/1990 | Moss | D32/14 |
| D. 307,496 | 4/1990 | Moss | D32/14 |
| 945,676 | 1/1910 | Baron | 131/247 X |
| 1,932,625 | 10/1933 | Hopple | 131/232 |
| 2,179,926 | 11/1939 | Doncourt | 131/232 |
| 3,362,416 | 1/1968 | Jackson | 131/232 |
| 3,524,535 | 8/1970 | Dundore | 131/247 |
| 4,027,681 | 6/1977 | Todd et al. | 131/232 |

*Primary Examiner*—Benjamin H. Layno
*Assistant Examiner*—J. Doyle
*Attorney, Agent, or Firm*—Alexander Norcross

[57] ABSTRACT

A small, portable, battery operated smoking pipe filling and cleaning tool. A series of small stepped plastic tubes are prefilled with tamped tobacco by the user and placed in a row in the case. To load a pipe, a tobacco filled tube is picked up and inserted within a pipe loader having a fixed central tamper surrounded by an annular spring loaded tube holder. The pipe bowl is then inverted over the tube and pressed downward. The tube, driven by the pipe bowl down against the holder, descends. The fixed tamper shoves the tobacco from the tube into the bowl. When the pipe is removed from the device the tube will readily fall free and the pipe is loaded with a charge of tobacco, correctly tamped for the smoker. The entire operation can be done by feel in one single up and down reciprocating motion. A battery operated, motor driven reamer is centrally mounted within an ash receptacle. A switch causes the reamer to rotate and vibrate. The pipe bowl is inverted over the brush and pressed downward. The brush removes the debris from the pipe without scarring the pipe, the debris falling into and being captured in a heat resistant chamber surrounding the brush. This permits the pipe to be readily cleaned by touch and without looking.

10 Claims, 3 Drawing Sheets

SMOKER'S PIPE FILLING AND CLEANING SYSTEM

BACKGROUND OF THE INVENTION

This invention relates to smoker's aids and more specifically, apparatus for assisting pipe smokers in filling and cleaning pipes.

A pipe smoker finds himself in a difficult and frustrating situation when he attempts to fill or empty a pipe with tobacco while driving a motor vehicle or operating equipment. A driver finds himself attempting to balance a tobacco pouch in one hand while simultaneously holding a steering wheel, and filling the pipe with his other hand while keeping his attention and his vehicle on the road.

After he has finished smoking, his frustration is compounded. It is generally impossible to knock the ash out of the bowl of a pipe into a vehicular ashtray. If he attempts to dig the dottle out of the pipe bowl he must, while driving, fish around for a pipe tool or a knife and then, keeping his eye on the road, scrape the bowl clean, hopefully not spilling the contents of the pipe bowl into his lap. This is obviously an impossible task, and the pipe smoker is often distracted.

There have been previous apparatus for pipe smokers to aid in the filling or cleaning of a pipe.

U.S. Pat. No. 3,362,416 to Jackson discloses a motor driven reaming device, surrounded by a flexible bellows, for reaming the interior of the bowl of a pipe. Please note that the collar is folded and flexible to permit the pipe to push it down, exposing the reamer. Under the bellows is a pressure switch which turns on the cleaner when the pipe depresses the bellows. The reaming blade is spring mounted so as to conform to the downward pressure of the pipe, preventing damage to the bowl of the pipe. A centrifugal fan mounted axially below the wheel blows the pipe debris into a chamber at the bottom of the cleaner. This fan also blows air from within the pipe through an odor reducing filter. The entire apparatus must be disassembled to remove the pipe debris.

U.S. Pat. No. 1,757,673 to Lazar discloses a tobacco container which contains a lower chamber having an internal tamping plunger for tamping tobacco into the bowl of a pipe.

U.S. Pat. No. 3,923,085 to Nimer discloses a "semi-automatic pipe loader" for automotive use. A tobacco container is mounted under the dashboard of a car. It contains a first opening for emitting tobacco and a spring-loaded trigger which, when activated, ratchets a paddle wheel within the tobacco container causing tobacco to fall through a bottom opening into the bowl of the pipe. The trigger mechanism is shaped like a tamper so that with a separate motion the tobacco can be tamped into the bowl of the pipe.

U.S. Pat. No. 2,306,622 to Gordon discloses another form of electric motor driven pipe cleaner, comprising a thin disc like brush or buffer wheel mounted transversely to the rotary axis of a small electric motor so that the wheel is spun within the bowl of the pipe for cleaning. This cleaner also shows a fan and a collection chamber for removing and disposing of the residue from the pipe bowl.

U.S. Pat. No. 3,587,594 to Keller discloses a pipe smoking or break in apparatus in which the pipe is held in a cradle and a supply of fan driven air is blown into the bowl of the pipe.

U.S. Pat. No. 3,524,535 to Dundore discloses a tobacco container having an internal pipe charging apparatus. The tobacco chamber has a lower end into which tobacco falls and against which the bowl of the pipe is placed. A finger operated, spring loaded plunger, internal to the tobacco chamber, then presses the tobacco into the bowl of the pipe. Note that, as with the previous pipe loading invention, the amount of tobacco which is loaded with a single charge is a function of how densely the tobacco falls from the bottom of the tobacco container. This device also must be held against the pipe.

U.S. Pat. No. 1,927,092 to Howard discloses a tobacco container and pipe filler in which the tobacco container is held vertically above the bowl of the pipe and a vertically disposed plunger is used to push tobacco into the bowl of the pipe. The plunger is not of the size as would normally be expected for pipe tamping; rather, a spiral mechanism on the plunger causes the device to rotate within the tobacco causing the tobacco to fall into the bowl of the pipe. The patent explicitly states that the primary purpose of the plunger is to agitate the tobacco into the bowl. The disclosed mechanism would not tamp the tobacco properly.

U.S. Pat. No. 997,974 to Drucklieb discloses an independent tobacco cartridge for carrying a charge of tobacco for loading into a pipe. These cartridges have independent finger operated plungers and lack an self-centering mechanism that allows the cartridges to be aligned by feel with the pipe.

U.S Pat. No. 779,095 to McInnis shows an early form of tobacco box having an internal tamper for dropping and tamping tobacco into a pipe.

U.S Pat. No. 1,001,242 to Berg discloses an alternate form of tobacco pouch with an internal tamp.

None of the disclosed devices show a combined loading and cleaning apparatus which can be easily used by one hand and by feel. None show a device which will load a pipe with a measured, consistent charge of tobacco.

SUMMARY OF THE INVENTION

A smoker's pipe system simplifies the task of filling a pipe with tobacco and extracting the ash from a pipe bowl. It is intended to give the pipe smoker the same degree of simplicity that a cigarette smoker enjoys in pulling a cigarette from a pack and depositing the butt in the ashtray.

The pipe system consists of two major sections in a single case to allow single-handed filling and/or cleaning of a smoker's pipe. The device is especially suitable for drivers. It allows pipe smoking drivers to fill or empty a pipe without taking their eyes from the road.

Two sections are shown. The first is a pipe loading section. A series of small stepped plastic tubes are prefilled with tamped tobacco by the user and placed in a row in the case. To load a pipe, a tobacco filled tube is picked up and inserted within a pipe loading section having a fixed central tamper and an annular spring loaded holder within which the tube is placed. The pipe bowl is then inverted over the tube and pressed downward. The tube is driven by the pipe bowl down against the holder and descends. The fixed tamper shoves the tobacco from the tube into the bowl. When the pipe is removed from the device the tube will readily fall free and the pipe is loaded with a charge of tobacco, correctly tamped for the smoker. The entire operation can be done by feel in one single up and down reciprocating motion.

The second section is a battery operated, motor driven brush centrally mounted within an ash receptacle section. A switch causes the brush to rotate. The pipe bowl is inverted over the brush and pressed downward. The brush removes the debris from the pipe without scarring the pipe, the debris falling into and being captured in a heat resistant chamber surrounding the brush. This permits the pipe to be readily cleaned by touch and without looking.

It is thus an object of the invention to show a pipe smoker's pipe loading apparatus which can load a pipe with a single one handed motion.

It is a further object of the invention to show a pipe smoker's pipe loading apparatus which can load a pipe with tobacco by feel.

It is a further object of the invention to show a pipe smoker's pipe loading apparatus which can be safely used by a driver, without visual distraction.

It is a further object of the invention to show a pipe smoker's pipe cleaning apparatus which can clean a pipe of ashes by feel.

It is a further object of the invention to show a pipe smoker's pipe cleaning apparatus which can be safely used by a driver, without visual distraction.

It is a further object of the invention to show a pipe smoker's combined pipe loading and cleaning apparatus which can be safely used by a driver, without visual distraction.

It is a further object of the invention to show a pipe smoker's combined pipe loading and cleaning apparatus which can be used by a pipe smoker by feel.

It is a further object of the invention to show a pipe smoker's combined pipe loading and cleaning apparatus which provides, to a pipe smoker, the convenience of use of a cigarette smoker's pack of pre made cigarettes.

These and other objects of the invention may be more clearly seen from the detailed description which follows.

DETAILED DESCRIPTION OF THE PREFERRED EMBODIMENT

Figure 1:
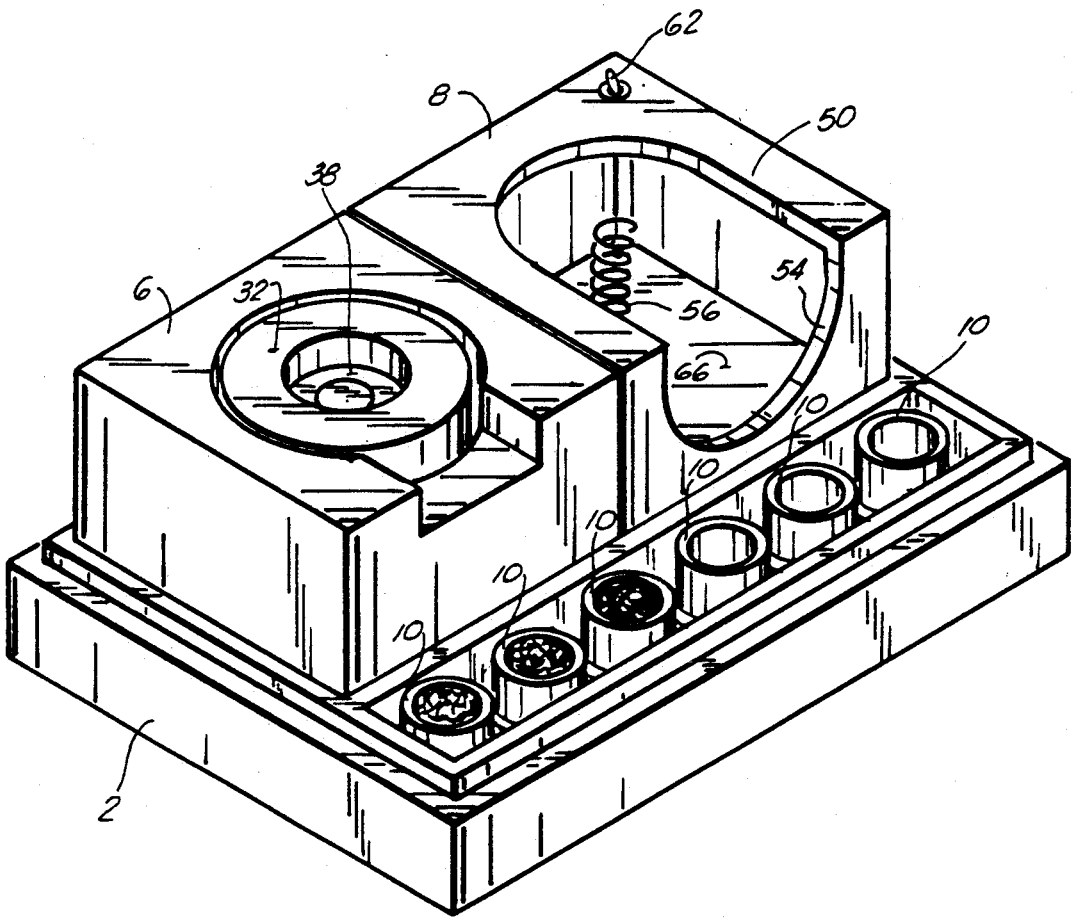
FIG. 1 is view of the invention is combination in its case.
Figure 3:
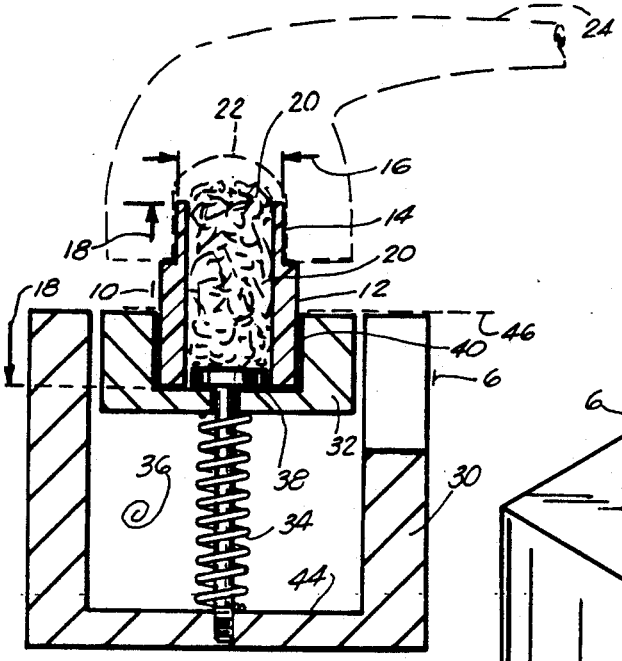
FIG. 3 is a side sectional view of the pipe loading apparatus with the tube holder in the first or upper position.
Figure 2:
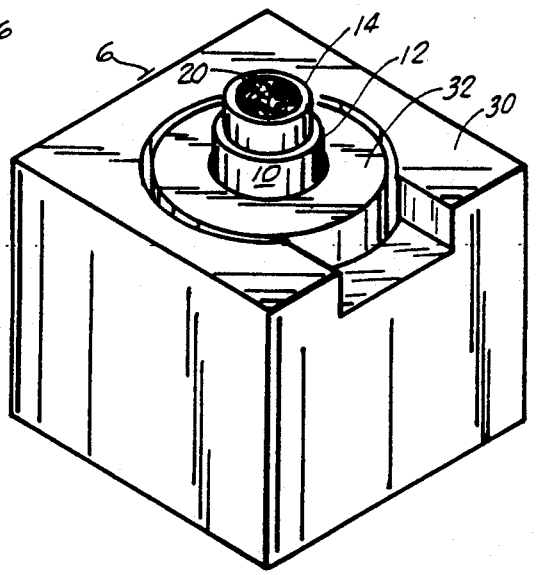
FIG. 2 is a view of the pipe loading box of the apparatus with a tobacco loaded tube inserted.
Figure 4:
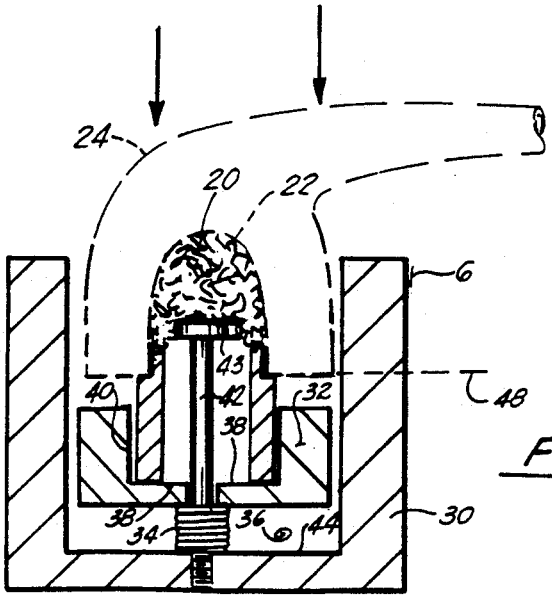
FIG. 4 is a side sectional view of the pipe loading apparatus with the tube holder in the second or lower position.
Figure 5:
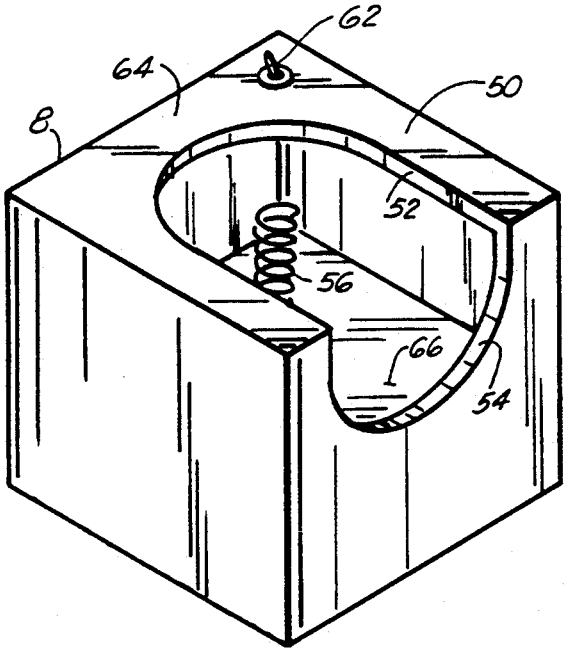
FIG. 5 is a view of the pipe cleaner of the invention.
Figure 6:
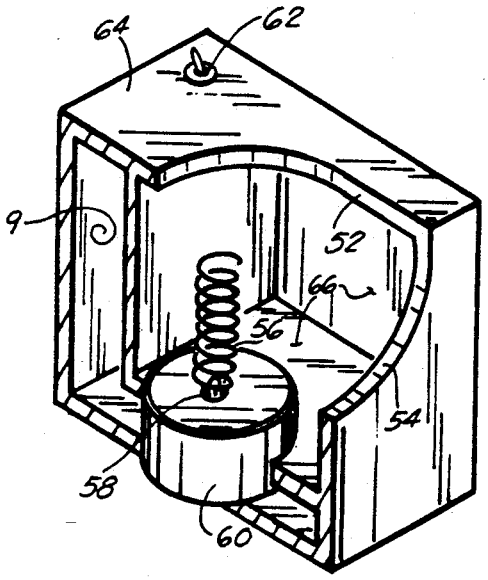
FIG. 6 is a cut away view of the pipe cleaner of the invention.
Figure 7:
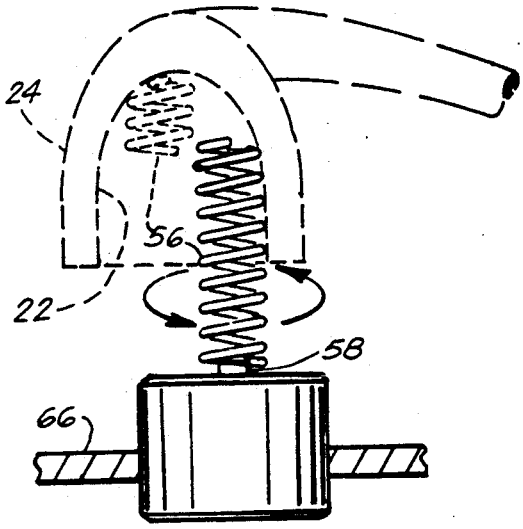
FIG. 7 is a figurative view of the reamer of the invention.

Referring to the figures, I show in a wooden case 2 having a hinged lid 4, a tobacco injector 6, a pipe reamer or cleaner 8 and a plurality of tobacco injector tubes 10. The tobacco injector tubes 10 are cylindrical hollow tubes, preferably made of a non-contaminating plastic such as pvc or a food quality plastic, having a lower base section 12 and an upper bowl insertion section 14, which is necked down, having a lesser outer diameter 16 than has the base section 12. The length 18 of the tobacco injector tube 10 is such that when packed with a pipe tobacco 20, the quantity of pipe tobacco 20 contained in the tube 10 is that sufficient to fill properly the bowl 22 of the smoker's pipe 24. The necked down diameter 16 of the tube 10 is sized to fit within the bowl 22 of a chosen smoker's pipe. It is found that in general pipes 24 have relatively uniform bowl sizes and therefore it is practical to provide tobacco tubes 10 sized to a few commonly available smoker's pipes 24.

The tobacco injector 6 consists of a base frame support member 30 within which is slidably affixed a pipe tobacco tube holder 32. The tobacco tube holder 32 floats or rests upon a spring 34 within an annular space 36 and is preferably itself a cylindrical section having an internal receiving lip 38 for supporting the tobacco tube 10 and a base collar 40 around the tube 10. A fixed tamper 42 extends vertically upward from the bottom 44 of the base frame support member 30, ending just below the tobacco tube 10 when the holder 32 is fully extended upward by the spring 34.

In the preferred embodiment, the tamper 42 forms a central axis, about which the spring 34 is wound; the tube holder 32 is also cylindrical, and is axially mounted about the tamper 42 above the spring 34, forming a cylindrical structure centrally mounted in the support member 30. This axial cylindrical mounting permits the tube holder 32 and spring 34 to be free floating, retrained on the support base only by the tamper 42, which is in the form of a fixed T-shape, the tamper head 43 serving to restrain the tube holder, which in turn restrains the spring 34. The tamper 42 is fixed to the base 30, in the preferred embodiment by screwing into the base 30. Clearly this is not the only way that the tube holder 32 and spring 34 may be assembled, and many alternate ways of fixing and placing the holder 32 for spring loaded movement up and down within the base frame 30 will suggest themselves to the skilled workman. The spring 34, for instance, need not be coaxial with the tamper 42, and need not be a coil spring, but may be any spring which will urge the tube holder up against a downward force, yet permit downward motion. Also it is clear that only the tamper head 43 need be circular in cross section to fill the interior of the tobacco tube 10; the tube holder may equally be square to match the shape of the provided case 2, or another useful or pleasing shape.

The holder 32 is spring loaded so that it may be depressed from its extended position 46 to a fully depressed position 48. The fully depressed position 48 is such that the tamper 42 extends upward through the tobacco tube 10 to a position level with the top of the tobacco tube 10.

In use, the smoker may provide a plurality of tobacco tubes 10, each filled with tobacco from a tobacco pouch, each containing sufficient tobacco 20 to fill a single pipe bowl full. When it is desired to fill a pipe 24 with a load of tobacco 20 a tube 10 may be pulled from the case 2 by feel alone, the flange or necked down collar 14 serving as a tactile identifier to permit the proper orientation of the tobacco tube 10. The collar 14 permits centering, by feel, of the tobacco tube 10 within the tobacco tube holder receiving lip 38. The pipe bowl 22 is then inverted over the tobacco tube 10 and pushed down. The downward motion of the pipe 24 first slides over the collar 14 of the tube 10 so that the tube 10 is inserted into and aligns with the bowl 22, and then the interlocked tube 10 and pipe 24 force down the tobacco tube holder 32 over the fixed tamper 42. The tamper 42 then transfers and tamps the tobacco 20 into the bowl 22. When the bowl 22 is removed, the tobacco tube 10 is readily freed by feel from the bowl 22. The pipe 24 has been filled with tobacco, by feel, and with a single hand motion.

The combination of the tobacco tube holder receiving lip 38 and the collar 14 on the tobacco tube 10 serve to permit easy orientation and insertion of the tobacco tube 10 and easy loading of the pipe 24, solely by feel, and without the necessity of the smoker taking his eyes off the road or turning from whatever task he is engaged in.

Placed beside the tobacco injector 6 in the case 2 is the pipe reamer 8.

For aesthetic reasons it is desirable that the tobacco injector 6 and that the pipe cleaner 8 be boxes of a symmetrical size and shape. This also permits both to be placed in an rectangular case 2, of pleasing aspect, and provides a space 3 for holding a plurality of tobacco tubes 10. This is possible inasmuch as the device being serviced, the pipe 24 is of a fixed, predictable size. Thus, in the illustrative version shown, both the injector 6 and the cleaner 8 are made in the form of cubes, which are then mounted within the case 2.

This permits the overall design of the smoker's pipe system to be made of an aesthetically pleasing shape and material, In the preferred version, the smoker's pipe system is made throughout of nicely grained hardwoods, which are finished to an attractive surface.

Within the shape of the pipe cleaner box 8 is provided an internal bowl shaped notch 50 open both on its top 52 and on its front 54. Centered within the opening created by the bowl receiving notch 50 is a spinning reamer 56. In one version of the pipe cleaner 8, the spinning reamer 56 is spiral of wire having a spring-like consistency, being compressible axially and being flexible or bendable along its length; any convoluted wire structure having both movements is equally suitable. However, it is clear that any of a number of flexible reaming structures may be employed so long as they are capable of bending or flexing under the pipe and so long as they are not hardened or sharpened so as to endanger or score the pipe bowl 22.

It is found that the described flexible wire structure is sufficient for wooden pipe and additionally, if made of soft coated wire, will not damage a Meerschaum or lined pipe bowl. Such wire may be coated with a heat resistant plastic or a smooth, relatively thick coat of a heat resistant paint.

It should be noted that, while heat resistance is specified for several components of the pipe cleaner 8, usually a pipe is cold and no sparks exist when it is cleaned and refilled. Such heat resistance is specified as a good design practice for the occasional live spark which may remain in a smoked pipe. Because of the limited heat exposure in this service, a wider range of materials and constructions will serve as heat resistant; the ability to withstand constant exposure to high temperatures is not required.

The reamer 56 is connected through a closed bearing 58 in the base of the pipe cleaner 8 to an enclosed sealed small electric motor 60 which is preferably powered by removable batteries (not shown). This motor 60 may be mounted externally to the ash receiving container 66, and for this reason could be enclosed in a separate compartment 9 of the box 8, the bearing 58 being mounted in a wall between such enclosure the box. Alternately, the motor 60 may be a sealed unit mounted within the ash receiving container 66; the closed bearing 58 would then be mounted within the case of the motor 60. A third alternative, shown in the drawings, is the motor 60 in a sealed case with the bearing 58 mounted in the motor case, and the case mounted in the wall between the ash receiving container 66 and the separate compartment 9. In this preferred embodiment, the separate 9 would contain batteries (not shown) for the power source, and would protect the switch 62, power source and any related wiring from the pipe ashes in the ash receiving container 66.

A single push button or small toggle switch 62 is provided on the top surface 64 of the pipe cleaner box 8 to one side, preferably the upper right side of the pipe cleaner box 8.

The interior of the pipe cleaner 8 forms an ash receiving container 66. The ash receiving container 66 should therefore be made of a heat resistant material; a finished wood box is typically found to be sufficiently heat resistant inasmuch as the ash receiving container 66 is sufficiently large as to allow ready cooling of any sparks in the dottle received into the ash container 66.

In operation the symmetrical shape and the size internal bowl shaped notch 50 permit ready tactile identification of the pipe cleaner 8. The user inverts the pipe 24, inserting it into the pipe cleaner 8. The shape of the opening 50 guides the pipe 24 so that the reamer 56 inserts centrally into the bowl 22 of the pipe 24. The location of the switch 62 is such that, especially for a right handed smoker, the fingers of the right hand are positioned over the control switch 62, so as to easily turn on the reamer 56, which then spins within the bowl 22, reaming the ashes from the pipe 24.

The removed ashes fall into the ash receiving container 66, free of the pipe 24. The reamer 56, being of a springy construction, vibrates sufficiently to remove the ash from all parts of the pipe bowl 22, but not being a hardened or a sharp structure, does not score or damage the bowl 22 of the pipe.

A left-handed smoker would naturally position the case 2 to his left; in this position he would be able to readily reach the switch 62 with his thumb.

The interior of the ash receiving container 66 is made sufficiently deep and large that the ashes of several pipe fulls of ashes may be contained therein until they can be removed or dumped at some convenient future location.

It can thus be seen from the detailed description of the invention that the device provides a convenient centralized unit which can be made in a very attractive form, and permits the easy loading and emptying of a smoker's pipe by feel rather than by sight. The unit is readily portable and thus can be taken with the smoker to be removed and the ashes dumped at a convenient location and the tobacco tubes refilled as desired.

A particular preferred embodiment has been illustrated in the drawing which has been designed for aesthetic attractiveness as well as for utility.

It will be apparent to those of skill in the art how many varying visual designs may be implemented within the scope of the invention and thus the invention extends to those wide range of variations as are inherent in the claims.

I claim:

1. An apparatus for filling a smoker's pipe comprising:

a base support frame;

a removable tobacco filled tube, vertically insertable within a holder within said frame, said holder being movable from a first to a second position;

means for urging said holder into said first position;

a tamper extending up through said holder, being below said tube in said first position, extending up through said tube in said second position, pushing thereby tobacco from said tube.

2. The apparatus of claim 1, said tube further comprising:

a cylindrical base adapted to removably mount in said holder;

a bowl insertion collar on an upper portion of said tube for aligning insertion into the bowl of a pipe.

3. The apparatus of claim 1, said means for urging comprising:

a spring, restrained within an annular space below said tube holder;

said tamper being axially mounted within said spring.

4. The apparatus of claim 1, said tube holder further comprising:

said tube holder having an internal receiving lip whereby said tube is supported.

5. The apparatus of claim 1, further comprising:

said tamper retaining said holder within said frame support member.

6. The apparatus of claim 1 further comprising:

said tamper extending downward axially through said holder;

said tamper being secured to said frame support member;

said tamper having wide, tube filling head, securing said holder thereby;

said means for urging being a spring axially wound around said tamper, between said holder and said frame support member.

7. An apparatus for filling and cleaning a smoker's pipe by feel comprising, in combination:

a pipe filler box;

a removable tobacco filled tube, vertically insertable within a holder within said pipe filler box, said holder being movable from a first to a second position;

means for urging said holder into said first position;

a tamper extending up through said holder, being below said tube in said first position, extending up through said tube in said second position, pushing thereby tobacco from said tube;

a pipe cleaner box having a pipe aligning opening into an ash receiving container;

a reamer mounted within said ash receiving container such that said reamer extends into a pipe inserted into said pipe aligning opening;

means for rotating said reamer;

said pipe cleaner box and said pipe filler box being mounted within a case; and said case supporting a plurality of said tubes.

8. The apparatus of claim 7 said tube further comprising:

a cylindrical base adapted to removably mount in said holder;

a bowl insertion collar on an upper portion of said tube for aligning insertion into the bowl of a pipe.

9. The apparatus of claim 7, said means for urging comprising:

a spring, restrained within an annular space below said tube holder;

said tamper being axially mounted within said spring.

10. The apparatus of claim 7, said means for rotating comprising:

a motor mounted within said box;

means for powering said motor;

said means for powering being controlled by a switch;

said switch being mounted on said box to the upper right side of said opening.

* * * * *